US005078378A

United States Patent [19]

Kapadia et al.

[11] Patent Number: 5,078,378

[45] Date of Patent: Jan. 7, 1992

[54] DYNAMIC SHEET COUNT PREDICTOR

[75] Inventors: Abde Kapadia, Webster; Daniel Fleysher, Pittsford; Gerald L. Coy; Kurt T. Knodt, both of Rochester, all of N.Y.

[73] Assignee: Xerox Corporation, Stamford, Conn.

[21] Appl. No.: 589,864

[22] Filed: Sep. 28, 1990

[51] Int. Cl.[5] ..... B65H 7/02

[52] U.S. Cl. ..... 271/3.1; 377/8

[58] Field of Search ..... 271/3.1, 155; 377/8

[56] References Cited

U.S. PATENT DOCUMENTS

| | | | |
|---|---|---|---|
| 4,076,408 | 8/1978 | Reid et al. | 355/14 |
| 4,469,320 | 9/1984 | Wenthe, Jr. | 271/98 |
| 4,535,463 | 8/1985 | Ito et al. | 377/8 |
| 4,589,645 | 5/1986 | Tracy | 271/3.1 |
| 4,610,444 | 9/1986 | Lang et al. | 271/12 |
| 4,815,725 | 3/1989 | Kanaya | 271/258 |
| 4,832,329 | 5/1989 | Rodi et al. | 271/155 |
| 4,960,272 | 10/1990 | Wierszewski et al. | 271/3.1 |
| 4,974,034 | 11/1990 | Rabb | 271/3.1 X |

OTHER PUBLICATIONS

Xerox Disclosure Statement, vol. 12, No. 12, Mar./Apr. 1987.

*Primary Examiner*—Richard A. Schacher

[57] ABSTRACT

In a system for detecting and signaling the approximate size of a set, stack or job of document sheets, especially for a recirculating type automatic document feeder with a document set stacking and feeding tray for a copier or other document imaging system, in which an electromechanical set separator system provides rough initial stack height and therefore set size or document number estimation signals from the position of the set separator arm on the stack, and in which there is also a counter for counting the number of document sheets fed out from the tray; the advance estimation of the number of documents to be fed to be imaged is significantly improved by dynamically comparing the count of the number of document sheets fed out from the tray at and with the transition in the set size estimation signal from the set separator system.

5 Claims, 4 Drawing Sheets

DYNAMIC SHEET COUNT PREDICTOR

Figure 1:
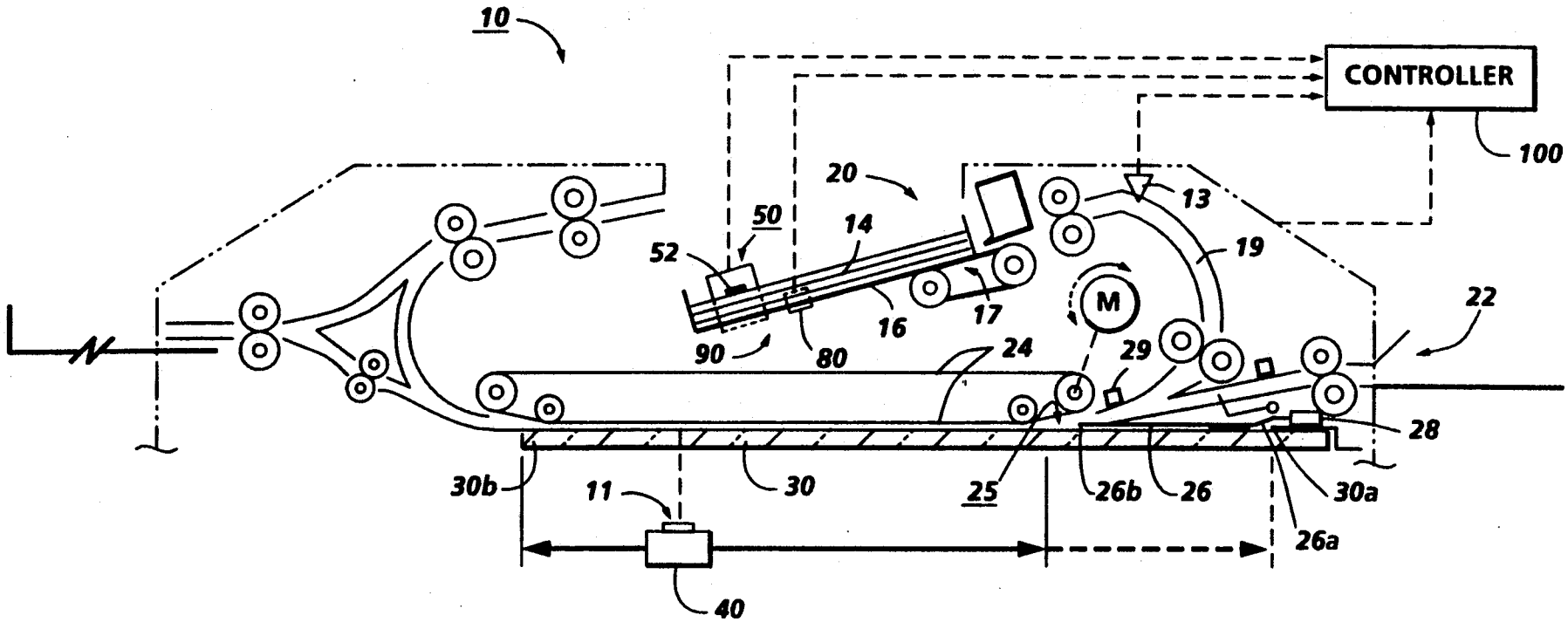

Cross-reference and incorporation by reference is made to a copending application by the same assignee, filed June 25, 1990, as U.S. application Ser. No. 07/543,031, by A. L. Bertoni, et al, entitled "Stream Printing". Also, to another copending application by the same assignee, filed July 2, 1990, by R. C. Ryon, et al, entitled "Dual Mode Document Registration System", application Ser. No. 546,984. The present system may be used in combination with "job streaming" printing as described in the former and/or in the apparatus disclosed in both, but is not limited thereto.

There is disclosed herein an improved control system for a copier or other document imaging system having an automatic document feeder into which a set of document sheets is initially loaded and sequentially fed out for their imaging. It is highly desirable that the total number of such loaded documents be estimatable in advance, for various control purposes.

There is disclosed herein an improved system for predicting and signaling for control purposes the size of a set or job of document sheets to be imaged and/or printed or copied, by a simple and low cost yet relatively accurate estimation or determination in relation to their stack height of the total number of document sheets to be imaged. It is especially usable with a recirculating type document handler (RDH) with an existing type of set separator system for a copier or other document imaging system.

The disclosed dynamic document set size estimation control system can dynamically compare the document sheet output count against the change in set separator stack height sensors status as the set separator arm is lowered as the stack is being fed to more accurately measure the stack height.

The present system can employ the operation of a known existing low cost electromechanical set separator in a known document feeder yet provide more reliable advance estimation of the total number of document sheets to be fed therefrom without waiting until all of them have been fed and counted by the existing downstream document sensor/counter in the document sheet feeding path. Thus an advance determination can be made of the number of document sheets in the document set being fed to provide or improve various control functions, including paper feeding operations or duplexing operations of an associated copier or printer.

One such potential function or application is to control so-called "stream printing", wherein the printing of copies begins before all the original documents have been scanned. [Note the first paragraph cross-reference.] Since the scanning of original documents and printing of copies is thereby disassociated, in general, the document scanning rate may, desirably, be less than the printer rate. Thus, to maximize overlapping of scanning and printing, the associated printer may be started after the scanner, but started early enough so that the last original is scanned just before the printer needs the image of that last scanned original for printing it. The desired start time of the associated printer is thus dependent upon the total number of originals to be scanned in that printing job, so a good advance estimate of said number of originals is very desirable. An objective or feature of this disclosure is to obtain such an accurate estimate of said number of originals for this or other purposes without having to manually count, prefeed, or provide a non-copying document circulation, or otherwise pre-count the originals.

Such set separators are well known in RDH's for precollation copying to tell when one complete feedout for circulation of the document set or stack by the RDH has been accomplished, before the next document set circulation. That is, to separate or distinguish those document sheets to be fed from those which have been returned to the document tray following the copying operation. The set separator or bail bar system typically has an arm or bail that is set on top of the stack of documents and drops down to actuate a switch when the last sheet of the set is fed out from under the arm. That is, when the finger is no longer over any documents it drops to signal that all the documents in that set have been fed out of the RDH tray once to copied. The finger or bail may then be automatically reset to the top of the stack to initiate another feed cycle, by a solenoid or other drive mechanism which pulls the finger back and then lifts it up to the reset position. This is needed to tell the system each time the complete document set is circulated, i.e. to keep track of the number of set circulations when their are recirculations. This is all described, for example, in Xerox Corporation U.S. Pat. No. 4,589,645 issued May 20, 1986 to M. J. Tracy, and art cited therein. That U.S. Pat. No. 4,589,645 set separator disclosure is partially included herein. The importance, applications and problems relating to such systems are also discussed in U.S. Pat. No. 4,469,320 issued Sept. 4, 1984 to S. J. Wenthe.

The set separator end of set or arm dropping signal is typically coupled through the copier logic system to another sheet sensor in the document feeding path which is used to count the number of sheets that were actually fed out before the arm dropped. With the combination of these two inputs or signals the precise number of document sheets in the document set can be readily determined, but only after the first full set feedout or circulation.

Of particular interest is the Xerox Disclosure Journal publication Vol. 12, No. 2, March/April 1987 at page 155. That publication describes shutdown protection at a preset maximum allowed document output sensor count, to protect from set separator failure such as arm dropping failure.

Of particular interest here, a preliminary stack height sensor estimator may be provided incorporated into such a set separator system, as also taught in said incorporated U.S. Pat. No. 4,589,645 to M. J. Tracy and said U.S. Pat. No. 4,469,320 to S. J. Wenthe. The reset position or rest angle of the set separator finger on the top of the stack can be sensed to give an indication of the stack height. Variations in the stack height variably reposition the finger relative to sensors. As indicated, that control information may be used for automatically adjusting vacuum, air, or normal force pressures in the document feeder, to compensate for the weight or height of the stack. More than one sensor can be provided for the various potential reset positions of the finger.

It is also believed that the accuracy of such a set separator system stack height sensor estimator system has been further improved in at least one commercial product, the Xerox Corporation "5090" copier RDH, by using an optical rotary shaft encoder driven by the set separator arm to provide multiply variable signals more accurately indicating the arm angle that the limited number of discrete sensors used in said U.S. Pat.

No. 4,589,645, or the like. However, that adds hardware costs and complexity to the set separator system.

In the said U.S. Pat. No. 4,589,645 M. J. Tracy type stack height sensor estimator set separator system, normally the stack height estimate is only made and reported at start of the RDH operation, before any documents are fed. The actual stack count is not re-estimated later, and is only known after the end of feeding and separately counting the entire set of documents. Also, with the above "5090" copier exception, this initial stack height estimate report is only a crude indication of one of the following conditions: no stack; or a "low", "medium", "high" or "oversize" stack. This provides only three operative stack height range estimates: a "low", "medium" or "high" stack. Due to these broad ranges (and variations in sheet thickness and/or sheet curl), there is only a very crude estimate of the actual number of sheets to be imaged. For example, a "high" stack might have approximately 50 to 180 documents, a "medium" stack from approximately 12–50 documents, and a "low" stack from 1 to approximately 12 documents.

Although the document set separator art is well developed, as shown by the number of references cited above and below, the very number of different designs which have been utilized is indicative of reliability and other problems associated therewith.

The following additional exemplary art is noted on set separator or bail bar systems per se, listed in numerical order: U.S. Pat. Nos. 3,556,513 issued Jan. 19, 1971 to A. Howard (Xerox); 3,815,896 issued June 11, 1974 to A. Hoyer (Xerox) (note especially FIGS. *7a–7c*); 3,861,671 issued Jan. 21, 1975 to A. Hoyer (Xerox); 3,895,790 issued July 22, 1975 to A. Hoyer et al. (Xerox); 3,941,376 issued Mar. 2, 1976 to K. Liechty, et al. (Xerox); 3,954,259 issued May 4, 1976 to D. Gerbasi (Xerox); 4,078,787 issued Mar. 14, 1978 to Berlew et al. (Eastman Kodak) (note Ref. Nos. 90, 91, 92, 125 and Col. 8, second paragraph, Col. 10, Paragraph No. 5 and Col. 11, first paragraph); 4,116,558 issued Sept. 26, 1978 to J. Adamek et al. (Xerox) (note item 61, 61a, 61b); 4,164,347 issued Aug. 14, 1979 to T. McGrain (Eastman Kodak); 4,231,561 issued Nov. 4, 1980 to T. Kaneko et al (Ricoh) (note e.g. Col. 11, lines 35–46); 4,231,562 issued Nov. 4, 1980 to T. Hori (Savin); 4,433,836 issued Feb. 28, 1984 to W. J. Kulpa et al (Pitney Bowes); 4,451,138, issued May 29, 1984 to C. P. Anderson (Ricoh); U.K. Patent Application GB 2,058,023A published Apr. 8, 1981 (Xerox); German OLS 2232023 laid open Jan. 17, 1974 by Licentia Patent-Verwaltungs GMBH; U.S.P.T.O. Defensive Publication No. T964,008 published Nov. 1, 1977 by W. E. Hunt (Eastman Kodak); the U.K. "Research Disclosure" Journal Publications Nos. 15842 of June 1977 and 20433 of April 1981; and the "Xerox Disclosure Journal", Vol. 5, No. 4 July/August 1980, p. 375, Vol. 5, No. 6, November/-December 1980, pp. 625–6, and Vol. 8, No. 3, May/-June 1983 pp. 189–190.

Other patent references particularly noted as of collateral background interest to different stack height estimating systems in general include U.S. Pat. Nos. 4,535,463; 4,610,444; 4,815,725; and 4,832,329.

Although of particular utility as part of a conventional optical (non electronic imaging) precollation copier with a multiply recirculating document handler, as additionally disclosed herein, the disclosed system may also be desirably used in a system for feeding a set of documents for electronic imaging.

For example, in a document feeder for an electronic document imaging and printing system, a set of documents normally need only be fed to be imaged once, and electronically stored, to make any number of ultimate printed copies. Yet even for electronic document imaging a known recirculating document handler (RDH), such as cited herein, can be desirable for feeding duplex (two-sided) documents. The RDH can be used to recirculate the document set twice, with inversion during the first circulation, so as to copy both sides of the documents more rapidly or efficiently, by imaging all of the even page sides in one circulation, and then all of the odd page sides in the next circulation, in contrast to a document handler which must invert and image both sides of each document one at a time in direct sequence.

As to the disclosed exemplary recirculating document handler (RDH) or document feeder, per se, it may desirably, with only minor control function modifications as described herein, be of a desirable known type. Such RDH's are well known for use with conventional optical light-lens copiers, although shown here with an electronic document scanner imaging system.

By way of background, disclosed herein by way of such example of an RDH is a well known dual input type of RDH, an RDH/SADH. RDH/SADH is a common abbreviation for a well known type of document handler with a top document loading tray recirculating document handler (RDH) mode and an integral alternative side document entrance or SADH slot providing a semi-automatic document handler (SADH) unidirectional document input. This disclosed RDH system allows documents to be automatically or semi-automatically fed onto an imaging platen from either infeeding position. Examples of patents thereon are cited below. However, this is merely exemplary, and the present invention is not limited to any particular type of recirculating or common tray restacking document handler or document feeder.

An example of such an electronic document imaging and printing system is disclosed in Xerox Corporation U.S. Pat. No. 4,757,348 issued July 12, 1988 to Rourke, et al and commonly filed U.S. Pat. No. 4,716,438 issued Dec. 29, 1987, that is compatibly usable with the present system, if desired. Among many other examples of platen scanning electronic imaging systems per se are Xerox Corporation U.S. Pat. No. 4,295,167 or related U.S. Pat. No. 4,287,536. The terms copying and imaging are used interchangeably in this particular case.

Also as to specific hardware components of the subject apparatus, it will be appreciated that, as is normally the case, various such specific hardware components are known per se in other apparatus or applications, including that described in art cited herein, and need not be re-described herein. Particularly noted as to the disclosed RDH document handling system is Xerox Corporation U.S. Pat. No. 4,579,444, issued Apr. 1, 1986 to Pinkney and Sanchez (D/84074), and/or other RDH art cited therein. Said U.S. Pat. No. 4,579,444 is of appropriate background interest as illustrating the general nature of the specific embodiment of the disclosed document handler and platen. Some other examples of prior art recirculating document handlers are disclosed in U.S. Pat. Nos. 4,278,344 issued July 14, 1981 to R. B. Sahay; 4,270,746 issued June 2, 1981 to T. J. Hamlin, and 4,076,408 issued Feb. 28, 1978 to M. G. Reid, et al. Also, in U.S. Pat. Nos. 4,176,945; 4,330,197, 4,466,733; and 4,428,667.

Said U.S. Pat. No. 4,076,408 issued Feb. 28, 1978 to M. G. Reid, et al also includes a separate optical emitter/detector 149, 151 in the document tray to detect the presence (loading) or absence of any documents in the tray. A similar disclosure is in U.S. Pat. No. 4,099,860 issued July 11, 1978 to J. L. Connin. More typically, such document tray "document presence" sensors are a conventional integral corner bottom light beam sensor unit, in which a light transmitter on the registration side wall slightly above the tray bottom transmits a light beam downwardly at an angle into an adjacent receiver or sensor in the tray bottom, and this light beam is occluded by any (even one) document sheet in the tray lying on the tray bottom. However, this "document presence" sensor information is normally used to tell the copier controller that the RDH tray mode of operation was in use, or, in clearing a jam, that there was a document to be removed and the reloaded with others in the document tray.

As noted in the prior art, as xerographic and other copiers and document imagers increase in speed, and become more automatic, it is increasingly important to provide higher speed yet more reliable and more automatic handling of the plural document sheets being imaged, i.e., the input to the imager and/or copier.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Plural sheets of documents being imaged as a group in some desired related arrangement, even if not in an actual page order, or their copies, are referred to as a "set". A "duplex" document is a sheet desired to be copied on both sides, as opposed to a "simplex" or single side imaged document.

A specific feature of the specific embodiment disclosed herein is to provide, in a sheet feeding and imaging system, with a sheet stacking and feeding tray in which a set of document sheets may be stacked to be sequentially fed from said tray by a sheet feeder for image processing, and sheet counting means for providing a count of the number of document sheets fed from said tray, and a set stack height estimating means for providing plural distinct discrete stack height control signals responsive to the height of said set of sheets in said tray, and control means electrically connecting with said set stack height estimating means for providing preset estimates corresponding to respective said discrete estimated stack height control signals of the number of said document sheets in said set; the improvement wherein said operation of said set stack height estimating means and said sheet counting means is dynamically monitored and compared by said control means for determining a specific said count of the number of said document sheets which have been fed from said tray prior to a change occurring in said distinct discrete estimated stack height control signals during at least the initial feeding of said document sheets, and said preset estimate from the respective said discrete estimated stack height control signal of the number of said document sheets in said set is modified in accordance with said specific count.

Further specific features provided by the system disclosed herein, individually or in combination, include those wherein said discrete estimated stack height control signals are a "high", "medium" and "low" signal; and/or wherein said modification of said estimated number of said document sheets in said set comprises said control means adding said count of said number of said document sheets which have been fed from said tray prior to a change occurring in said discrete stack height control signal to said prior preset estimated number of said document sheets in said set corresponding to the most recent said discrete stack height control signal thereto; and/or wherein said control means interrogates said stack height control signals of said set stack height estimating means repeatedly at a periodic rate, only under conditions indicative of a change in said discrete stack height control signals to a new stack height control signal indicative of a smaller stack, and only responds thereto after a preset number of successive identical said periodic interrogation sensings of said new and smaller stack height control signal, to provide filtering for avoiding erroneous stack height control signal readings; and/or wherein said sheet feeding system is a recirculating document handler and said set of document sheets are a set of documents being plurally recirculated in a document circulation path for imaging and returned in said document circulation path back to said same tray to be restacked in said same tray; and/or wherein said set stack height estimating means is an electromechanical system in which a finger is set on top of said set of document sheets as they are initially loaded into said tray, and said document sheets are fed out from under said finger by said sheet feeder, and the position of said finger provides said discrete stack height control signals.

Further specific features provided by the system disclosed herein, individually or in combination, include a method of sheet feeding and imaging, with a sheet stacking and feeding tray in which a set of document sheets are stacked to be sequentially fed from said tray by a sheet feeder for image processing, and with sheet counting means for providing a count of the number of document sheets fed from said tray, and a set stack height estimating means for providing plural discrete stack height control signals responsive to the height of said set of sheets in said tray, and providing preset estimates corresponding to respective said discrete estimated stack height control signals of the number of said document sheets in said set; the improvement wherein said operation of said set stack height estimating means and said sheet counting means is dynamically monitored and compared during at least the initial feeding of said document sheets to determine a count of the number of said document sheets which have been fed from said tray prior to a change occurring in said discrete estimated stack height control signals, and modifying said preset estimate of the number of said document sheets in said set in accordance with said count; and/or wherein said modification of the estimated number of said document sheets in said set comprises adding said count of said number of said document sheets which have been fed from said tray prior to a change occurring in said discrete stack height control signals to said prior preset estimated number of said document sheets in said set corresponding to the most recent said discrete stack height control signal, but only in response to a consistent stack height control signal indicative of a smaller stack height.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc.. The resultant controller signals may conventionally actuate various conventional electrical solenoid or camcontrolled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their positions, counting the number of completed document set circulations and completed copies, etc., and thereby controlling the operation of the document and copy sheet feeders and inverters, etc..

All references cited in this specification, and their references, are incorporated by reference herein where appropriate for appropriate teachings of additional or alternative details, features, and/or technical background.

Figure 2:
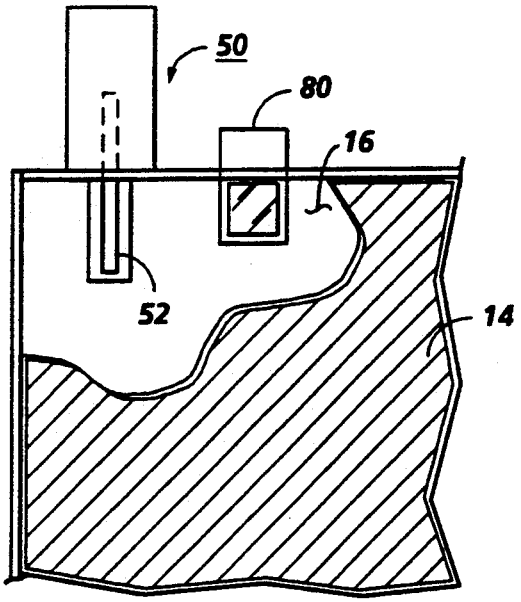
Figure 3:
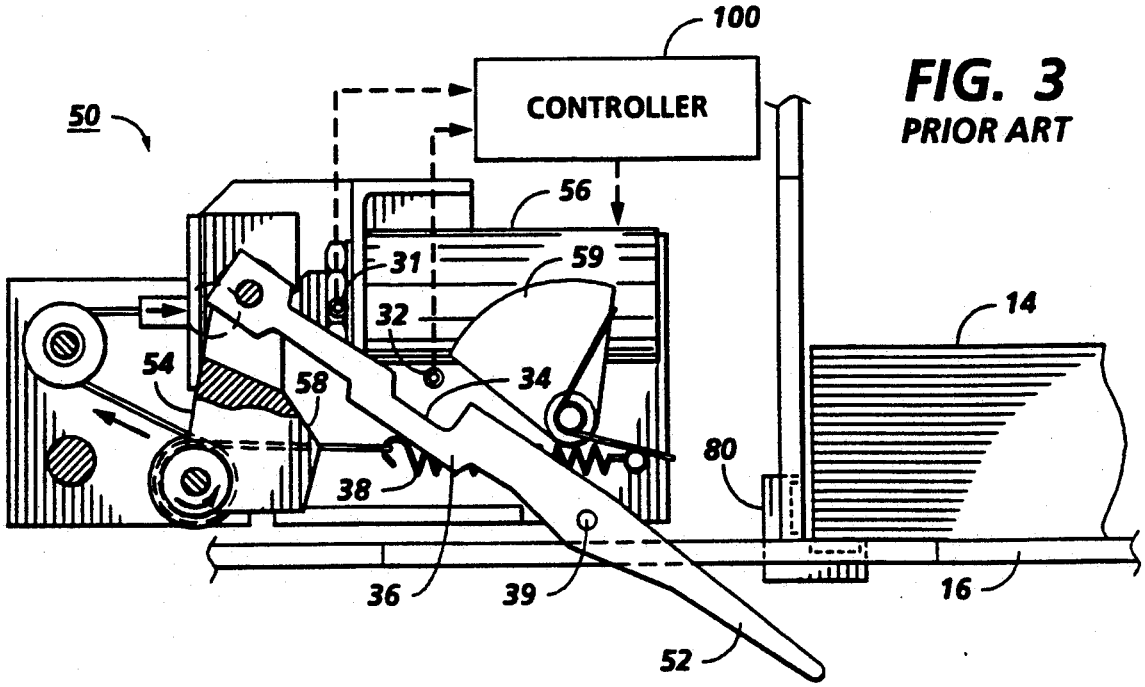
FIG. 3 PRIOR ART

Various of the above-mentioned and further features and advantages will be apparent from the specific apparatus and its operation described in the example below, as well as the claims. Thus the present invention will be better understood from this description of an embodiment thereof, including the drawing figures (approximately to scale), wherein:

FIG. 1 is a schematic side view of one embodiment of the system of the invention, showing an exemplary RDH document handler with an exemplary dynamic document set size estimation control system therefor;

FIG. 2 is an enlarged partial schematic top view of one portion of the embodiment of FIG. 1; and FIGS. 3–7 are views of the prior art exemplary disclosed set separator per se of the embodiment of FIGS. 1 and 2, taken from the above-cited U.S. Pat. No. 4,589,645 drawings, in which FIGS. 4–7 are partial (simplified) front views of the prior art set separator embodiment of FIG. 3, showing different positions of the operation thereof.

Describing now in further detail the exemplary embodiment with reference to the Figures, this disclosed dynamic document set size estimation control system 90 is shown in FIGS. 1 and 2 as a part of an exemplary integral document handling and imaging or copying system 10 with a recirculating document handler 20 shown by way of one example of a document handler for use with and/or control by the subject document detection and control system.

The RDH 20 may be conventional and may be mounted to, as a part of, any conventional copier. Furthermore, the present system is applicable to numerous other sheet feeding systems, of which this is merely one example. Further details are described in the above-cited and other references, and need not be repeated herein. This otherwise conventional recirculating document sheet handler 20 may be used for precollation copying, in which a stack 14 of individual flimsy document sheets are loaded into the generally horizontal and planar bottom surface of a restacking tray 16 to be fed seriatim from the bottom of the stack 14 by a vacuum belt or other individual sheet output feeder 17, assisted by an air knife, as shown, both of which are adjacent the front or downstream edge of the stack 14. Each sheet, after it has been fed out to the copier platen and copied, is returned via a restacking feeder or transport which feeds the returning sheet in over the top of the stack 14 from the rear of the stack and releases the sheet to restack by settling down on top of the stack between aligning edge guides. Thus, the document sheets can be continuously recirculated, in the same order, as often as desired.

The disclosed dual mode document registration document handler 20, which has a special, different, mode of operation for large documents, e.g., 11"×17" or A3 documents. However, this is merely exemplary, and the present invention is not limited to any particular type of document handler or document feeder. In this particular document handler or feeder 20 large documents are preferably fed into the alternative side entrance or SADH slot 22 of the document handler 20, as compared to normal size documents which may be inserted either there or in the top or RDH stacking tray 21.

The illustrated exemplary document handler 20 is an dual input RDH/SADH unit very much like that shown in the above-cited Xerox U.S. Pat. No. 4,579,444, issued Apr. 1, 1986, although FIG. 1 there is a reversed, mirror image, or rear view a compared to FIG. 1 here. Thus, this RDH/SADH 20, including its exemplary side or SADH entrance 22, may be basically as described in that patent, except as to the novel aspects described herein. Likewise, the RDH/SADH 20 and its drives and sensors are generally conventionally connected to and controlled by a conventional programmable controller 100, programmed as further described herein.

Normally, as described in the cited and other art, a set or stack 14 of normal sized documents is placed in the RDH 20 top document tray 16. They are sequentially fed from by the tray 16 a pneumatic bottom separator/-feeder 17 and counted by being fed by a conventional optical sheet edge sensor 13. They are further fed in the arcuate path 19 to meet up with or merge with the alternate SADH document entrance 22 path, which also feeds documents, to the upstream end of the platen transport belt 24 and onto the platen 30 at an infeeding position 25 there. This infeeding position 25 at which the document is initially fed onto the platen 30 and acquired in the nip therewith of the platen transport belt 24 here is substantially upstream of the upstream end 30*a* of the platen 30.

Just upstream of this document infeeding position 25 here is another conventional document edge optical sensor 29 (corresponding to reference 31 in the cited 4,579,444). In this particular RDH 20, an underlying pivotal infeeding area light reflective baffle 26, preferably liftable by a solenoid 28 closely overlays the platen 30 in the area thereof extending from the platen upstream edge 30*a* to the infeeding position 25. This infeeding area light baffle 26 is otherwise somewhat similar that shown and described in XDJ Vol. 7, No. 4., July/August 1982, p. 275.

The disclosed electronic document imaging system 11 may be utilized in lieu of a conventional light-lens imaging system for electronic document imaging for a subsequent or integral printer. The electronic optical scanning system 11 reads document images on the imaging platen 30. As disclosed here schematically in FIG. 1, an exemplary electronic image scanning system 11 may be provided scanning from under the platen 30 with a scanner 40 which may be mounted on and reciprocally driven by a typical horizontal optical scanning carriage. The electronic image scanning system 11 here provides for scanning up to the full length or the entire area of the platen 30, from the ends 30*a* to 30*b*, (see the movement arrows) to be able to image a document of any size which can be fitted onto the platen 30 upper surface. Conventionally, a document illuminating lamp and reflector light source may be located on the same scanning carriage.

The electronic imaging member 40 may be a conventional full width imaging bar or scan head CCD sensor array, preferably with an integral conventional lens strip such as a well known Selfoc TM multi-element lens or fiber optics array, as in U.S. Pat. No. 3,977,777, for example. Such electronic digitizing of the document image, for integral or separate digital copying, printing, facsimile transmission, and/or other digital image processing, enhancement, and/or manipulation, is rapidly becoming more important and critical, as compared to conventional copying with conventional light lens optical input, or the like. This is sometimes called an "EFE" or "electronic front end". Above-cited examples included Xerox Corporation U.S. Pat. Nos. 4,757,348, 4,295,167 and 4,287,536. The electronic image scanning may be bidirectional, as is known for example from Eastman Kodak U.S. Pat. No. 4,150,873 issued Apr. 24, 1979 to G. Dali and Xerox Corporation U.S. Pat. No. 4,205,350. Also, various electronic buffer and page collation systems may be connected to or made a part of the EFE, as disclosed in above-cited references, IBM Corp. U.S. Pat. Nos. 4,099,254 or 4,213,694; Eastman Kodak Canadian 1,086,231 or UK 1 531 401; the Xerox Corporation "1200" and "9700" printers, etc..

With document handler 20, normal sized documents are fed and registered and ejected entirely unidirectionally on the platen 30, in a generally conventional manner, with the servo-driven non-slip platen transport belt 24. Thus, normal size automatically fed documents are registered in a registration position entirely under the platen transport belt 24, downstream from the baffle 26.

However, with this particular document handler 20, a large oversize document (only) is initially fed onto the platen 30 in the same manner and direction but then is automatically treated differently, in accordance with being sensed as being oversized as it is fed in. The large document feeding continues until the downstream or lead edge area of the large document is overfed past the downstream end 30*b* of the platen (so that the lead edge area of the document actually briefly enters into the document exit or post-platen ejecting area 31). At that point in time, the trail edge of the oversized document has passed the upstream document edge sensor 29 and the downstream edge 26*b* of the baffle 26 in passing through the infeeding position 25 so that the length and oversized nature of that document is known by the copier controller 100. An oversized document includes any document which, at the feed-in point, exiting the infeeding position 25, would have any portion thereof extending beyond the downstream edge 30*b* of the platen 30, and would be imaged that way if handled as a normal document. In response to that oversize information, the document platen transport is automatically reversed (but preferably operated at a much slower reverse speed than the forward speed), and the document is "backed-up" into a desired copying position registered relative to the upstream platen edge 30*a*. That reverse document movement into the large document copying position moves the trail edge area of the large document back under the infeeding baffle 26 towards the upstream edge 30*a* of the platen. The backing-up of a document, and the coordinated lifting of the baffle 26 downstream end 26*b* by solenoid 28 as described herein, is automatically actuated only for documents which are sensed as being oversized. All documents are feed in onto the platen 30 through the normal SADH or RDH input path guide baffles leading to input area 25, as shown, which baffles are above the baffle 26. The end of these document entrance baffles provides a document infeeding entrance position at the input area 25 which the trail edge of the documents must clear or exit.

In the example here, the solenoid 28 is connected to the upstream end 26*a* of the baffle 26, and horizontal movement downstream of the baffle 26 by actuation of the solenoid 28 lifts the downstream lip 26*b* of the baffle 26 away from the platen 30 and above the plane of the platen transport belt 24 lower flight. In that raised position, the baffle lip 26*b* and associated (now inclined) lower surface of this baffle 26 in effect becomes a stripping gate or deflector to ensure that the previously trailing edge of the now reversed movement large document will back up under, rather than over, the baffle 26.

When the solenoid 28 is not actuated, the baffle 26 is dropped or lowered into its normal generally horizontal position directly overlying the platen 30, by being lowered substantially into that plane. Preferably the lower surface of the baffle 26 is normally allowed to rest directly and flatly on the platen 30 upper surface by gravity when the solenoid is 28 is disengaged. I.e., preferably here the input path of a large document as well as a normal document is above or over the top of the baffle 26, and with the baffle in its lowered position, as previously noted. In the case of normal sized documents, the solenoid 28 need never be actuated and the baffle 26 can stay down flat directly on top of the area of the platen it overlies at all times.

Before turning to the disclosed example of the specific system of the invention, the overall dynamic document set size estimation control system 90 includes a set separator unit 50, which is integral the automatic recirculating document handler 20. Thus, an example of the set separator unit 50 will now be described. Both the the set separator unit 50 and a document presence sensor 80 are connected to the controller 100.

Describing the exemplary set separator unit 50, per se, here this is a prior art example from U.S. Pat. No. 4,589,645, except that in FIG. 1 it is illustrated located in the registration side wall near the rear or restacking end of the document tray 16 of the RDH 20. It may be in said rear or restacking end of the document tray 16 instead. It includes an integral finger, arm or bail 52 normally rests on the stack 14 lightly. The finger 52 moves down with gravity as sheets are fed out from the bottom of the stack 14, and are therefore fed out from under the finger 52. When the finger 52 is no longer over any more documents it drops through a slot in the tray 16 bottom, shown if FIG. 2, into a position to activate a photo switch which signifies that all the document sheets in the set have been fed out of the tray 16 to be copied once, i.e. circulated once. The finger 52 is then automatically reset to an initial or reset position on top of the stack 14, to initiate another cycle, by a solenoid actuating mechanism.

The sensed position of the finger 52 on the top of the stack 14, on which the finger 52 is automatically placed before any document feeding is initiated, may also utilized to provide an indication of the stack height, for automatically adjusting vacuum, air, and/or normal force pressures in the document feeder to compensate for the height (and therefore indirectly for the weight) of the stack, as further described, for example in the cited U.S. Pat. No. 4,589,645 or 4,469,320.

Further describing from U.S. Pat. No. 4,589,645 the mechanical structure and operation of the document set separator/circulation counter system 50, re FIGS. 3, et al, this particular set separator unit 50 has its finger, arm or bail 52 controlled by its eccentric pivotal connection to a single rotated arm or sector 54, with a cam 58, providing all of the required movements of retraction, lifting, reextension and dropping of the bail or finger 52. The set separator unit 50 is positively driven by its arm 54 and its cam 58 through the reset cycle. The increased length of the separator finger 52 decreases the angle at which it rests on top of the document stack 14.

The bail arm or finger 52 is returned to the top of the document stack 14 with a minimum number of parts. The finger 52 is pivotally connected to the rotary arm or sector 54, which is rotated by a cable pulley attached to it. The arm 54 and its integral cam 58 is partially rotated, by approximately 60 degrees, by means of a solenoid 56 via this cable attached to the pulley. For the first 25 degrees or so, the finger 52 is pulled back basically horizontally. The finger 52 is moved about one-half of its total retraction before it begins any upward movement, to ensure that it is well behind the stack before it is lifted. Then in the final 35 degrees, the finger 52 is lifted up, by the cam 28. A spring action then returns the solenoid and propels the arm 52 through its return path back out over the document stack. A simple and inexpensive linear (or rotary) solenoid 56 may be used, preferably with a connecting cable, pulley, and spring 38 arrangement as shown, so that retraction of the bail 52 away from the stack is by the solenoid 56 pull-in, while return movement is by the opposing spring force rotating the arm 54 back towards the stack (in the opposite direction).

To re-express the above, the disclosed document set separator unit 50 has a finger or elongated bail 52 having one end thereof eccentrically mounted to an oscillating solenoid driven arm or disc 54. This arm 54 has a cam surface 58 oscillating therewith which operates intermittently on an intermediate portion of the finger 52. This combination drive provides, first, a quasi-linear retraction of the previously dropped separator finger or bail 52 away from under the end of the stack 14, then its arcuate elevation, once free of the end of the stack, and then its quasi-linear return (preferably with the aid of an elevation retaining cam surface or magnet) back out over the top of the stack, extending the finger 52 out over (above) the stack without contacting it, and then dropping it down onto the top of the stack, well away from the edge, unconstrained, so that it drops onto the upper surface level of that particular stack. About one-half of the total travel of the bail 52 is basically horizontal only. This travel is provided for the bail 52 in its initial retraction movement away from the end of the stack. This insures that the end of the finger 52 is pulled all the way out from under the end of the stack 14 before any lifting of the finger 52 is initiated.

Note that the unique shape of the central portion of the arm or bail 52 itself controls the blocking and unblocking of two commercial photo-optical pair sensors 31 and 32. These are an upper, stack height, sensor 31, and a lower, set separator, sensor 32. Here, as will be described, these sensors are directly tripped by the bail arm 52 itself, for more precise document stack height sensing. Specifically, there is provided a preformed notch 34 on one side of the finger 52 and a projecting tab 36 on the opposite side. It will be appreciated that other suitable configurations may be provided. There is a preset vertical distance (arm 52 width) therebetween relative to the vertical distance between the two sensors 31 and 32, and a preset horizontal extent of both the notch 34 and tab 36. The horizontal extent thereof controls the blocking or unblocking of the sensors during the reset operation, when the arm is being fully retracted, as will be explained. The tab 36 and notch 34 enable the two sensors to be further apart and less critical as to arm movement position, i.e. provide a more accurate stack height indication less affected by the sensor mounting positions, for more accurate input to their connecting input to the conventional microprocessor controller 100, which in turn controls the stack feeder 17, particularly the air level control thereof, as described in the above-referenced patents.

The two spaced sensors or switch means 31 and 32 are positioned to be variably actuated by the notch 34 and tab 36 in response to variable positions of the set separator finger 52 for actuating one, none, or both of said sensors 31 and/or 32 at respective vertical (and horizontal) positions thereof. In response thereto, the controller 100 provides six different automatic control outputs in response to four different combinations of sensed actuations or non-actuations of said two spaced sensors 31 and 32 and the operating times at which said combinations of actuations or non-actuations are sensed. These six different automatic controls in response to four different combinations of sensor actuations or non-actuations provide respective signals responsive to a stack which is too high for reliable feeding, a stack which is high, a medium height stack, a low stack, no stack, or the end of a circulation of the stack.

In response to one of said four combinations of actuations or non-actuations of said switch means 31 and 32 the solenoid 56 is actuated by controller 100 to withdraw the set separator finger 52 from the stack 14 and reset it on top of the stack, as described. In the end-of-set (or no document present) position of FIGS. 3 and 4, it may be seen that both sensors 31 and 32 are uncovered or unoccluded. That is, the opposing light source for each sensor reaches each sensor without blockage by any portion of the set separator finger 52 being therebetween. This starts or initiates the resetting cycle shown in the respective Figures. Retraction movement is started as shown by the movement arrows in FIG. 4.

Figure 4:
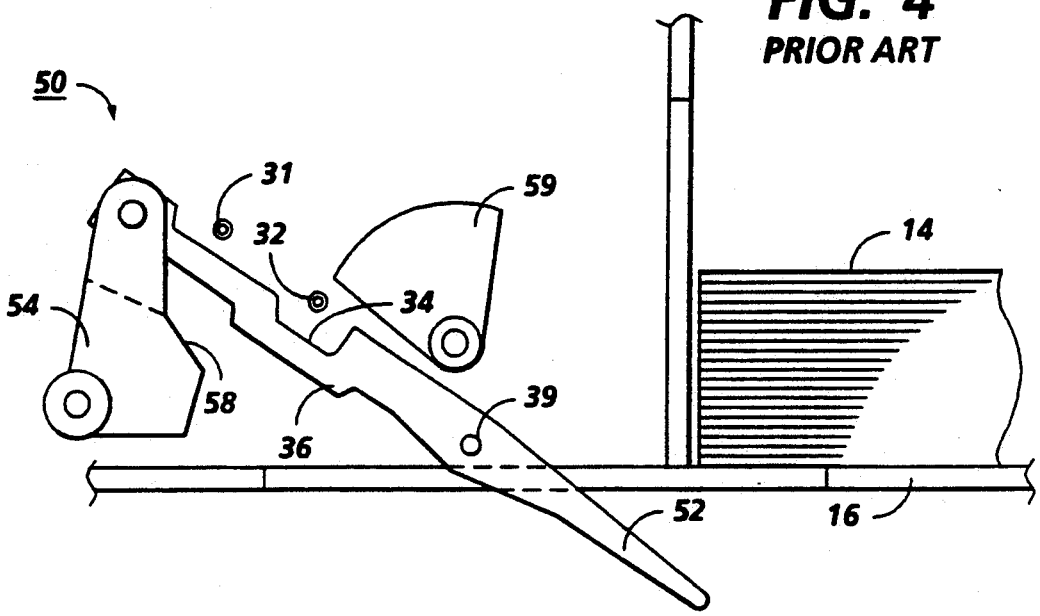
FIG. 4 PRIOR ART
Figure 5:
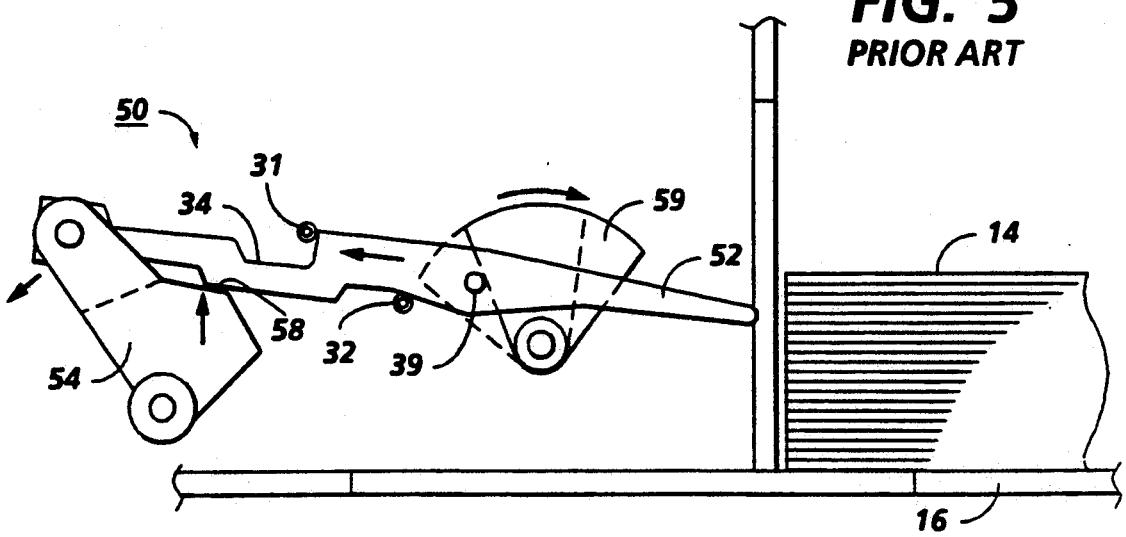
FIG. 5 PRIOR ART
Figure 6:
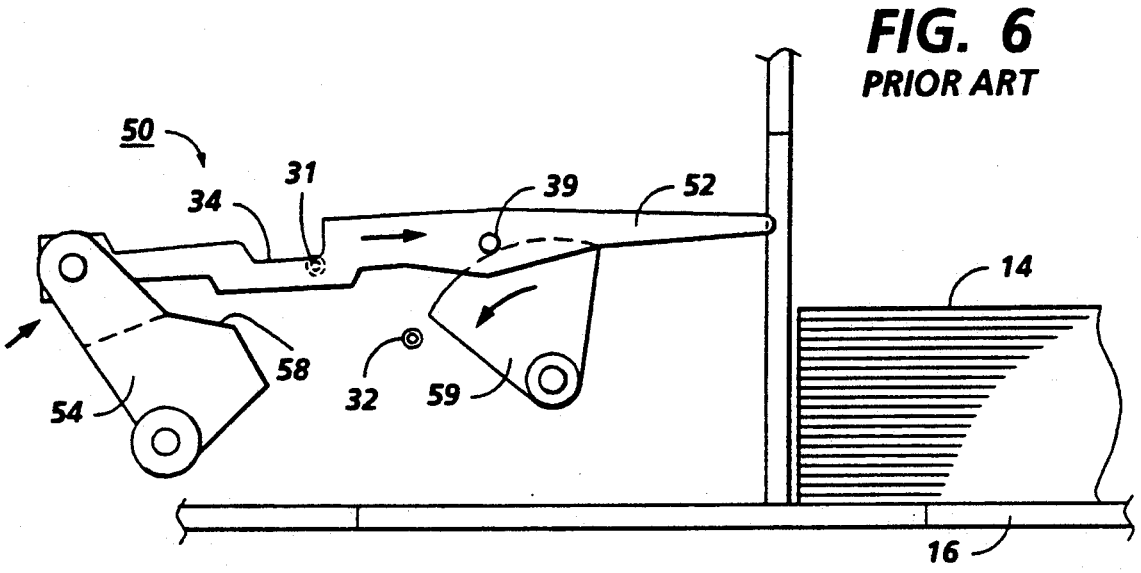
FIG. 6 PRIOR ART
Figure 7:
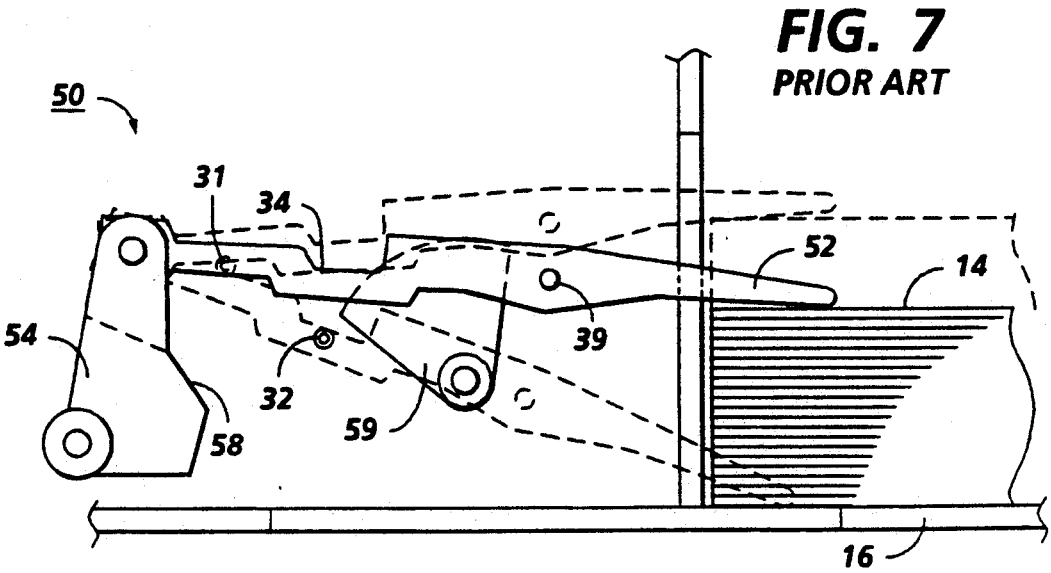
FIG. 7 PRIOR ART

Referring now particularly to the various illustrated operating positions of the set separator system 50 variously illustrated in FIGS. 3–7, FIGS. 3 and 4 show the system after the finger 52 has dropped through the slot in tray 16 as described above, and just as it is about to be reset. FIG. 5 shows the system near the end of the finger 52 retraction step of the resetting operation, as the cam 58 is lifting the finger 52 vertically. FIG. 6 illustrates the return movement of this resetting operation. FIG. 7 illustrates the finger 52 in its returned (reset) stack height sensing position, for three different stack heights.

At the end of the pull-in stroke of solenoid 56, a pin 39 on finger 52 is lifted up above the rear lip of an additional (optional) return cam 59. The cam 59 is pivotally spring-loaded to positively snap back under the pin 39 at that point (see the dashed-line position of cam 59 in FIG. 5 vs the solid line position thereof). Thus when current is removed from solenoid 56, spring 38 rotates arm 54 forward, as shown in FIG. 6, and pin 39 rides up over the top of cam 59 to hold finger 52 up above the highest possible stack 14, and the finger 52 is advanced out over and above stack 14. When pin 39 reaches the end of the cam 59 cam surface the finger 52 is then free to drop down vertically onto the top of the stack, down to whatever the height of that stack may be, and at a position well beyond the stack edge, so as not to read or be affected by any edge curls in the documents at the edge of the stack.

Even in the above-described resetting operation, the sensors 31 and 32 serve a function. The controller 100 logic "looks" at the inputs from these sensors, at the time it is providing the actuating signal to the solenoid 56, to check for occlusion of the upper sensor 31 and not the lower sensor 32, as shown in FIG. 4. When that combination of 3 signals occurs, the controller 18 knows that the finger 52 has been lifted up or "cocked" by cam 58 and is in the correct position for release of solenoid power for the return or resetting movement of finger 52. Note that this is accomplished by terminating the notch 34 in finger 52 at a position relative to the "cocked" position of finger 52 such that an unnotched portion of finger 52 will block sensor 31. Note also that sensor 31 is positioned horizontally rearwardly of sensor 32, as well as vertically spaced thereabove. The combination of a solenoid operating signal and blockage of only sensor 31 signals the release of finger 52 to immediately fly forward and then immediately drop to detect stack height, if any.

As the outer or height-sensing end of the finger 52 drops onto the stack, the inner portion thereof including tab 36 correspondingly drops sequentially past the sensors 31 and 32 to provide stack height sensing information.

Assume first an "overstack" condition, as shown by the uppermost dashed-line positions of stack 14 and finger 52 in FIG. 7. In that condition (too many documents for reliable document feeding) neither sensor 31 nor sensor 32 will be occluded. The finger 52 dropping motion is stopped before it drops far enough for finger 52 to even cover upper sensor 31. Note that in this position the tab 36 is now forward of sensor 31 and cannot intercept sensor 31.

A stack 14 level which is high, but not overstacked, is exemplified by the solid line position in FIG. 7. There is a preset range of such "high" stack levels, which is sensed by occlusion of only sensor 31 but not sensor 32, as shown. This provides a "heavy" stack signal output from controller 100, which can provide a higher level air-knife level control. This "high" (but not "overstack") range may be, for example, for stack heights of, for example, from 25 mm. to 6.5 mm.

If the stack 14 height is in a "medium" range, the system is designed so that both sensors 31 and 32 are occluded in this range. In this "medium" stack range, tab 36 covers sensor 32, yet sensor 31 also remains covered by the rear of finger 52. This "medium" stack height range extends over a range of finger 52 initial reset positions from the above-described "high" range up to a "low" stack position. This "medium" stack height range may be, e.g., for stack heights of from 6.5 mm. to 1.5 mm., and can be used to set a corresponding medium level air control.

"Low" stack heights are illustrated by the lower dashed line position of finger 52 and stack 14 in FIG. 7. For "low" stacks only the lower sensor 32 is occluded, and the upper sensor 31 is now uncovered. This 32 but not 31 signal combination tells the controller 100 that some, but only a small number, of sheets are in tray 16. The air knife pressure level may be reduced accordingly to avoid over-fluffing the small stack. Thus, the set separator system 50 here can automatically provide a variable pneumatic setting for sheet feeding, including an accurate air knife level for the particular thickness of the sheet stack being fed, thereby minimizing misfeeds or jams.

If the finger 52 drops all the way down immediately after the resetting operation, uncovering both sensors, then the controller 100 knows that there is no stack present, i.e., no documents have been loaded, or they have all been removed from the tray. In contrast, if this drop signal occurs after a time delay after a normal reset to one of the stack height positions, it provides and end of set circulation signal.

Turning now to the specific dynamic document set size estimation control system 90 disclosed herein, the above described stack height range information signals from the document sheet set separator 50, or other set separator, are combined as they occur or coincide with the document sheet edge detector sensor and sheet feeding counter 13 (or 29) in the controller 100 to provide a dynamic set size estimation control system. The control algorithm can be provided by already exisiting hardware, and simple software, and therefore be very inexpensive. Yet it provides much better estimating, in advance, for various control purposes, of the number of initially loaded (and/or remaining) documents 14 in the tray 16 (the total number of document sheets to be imaged) before they are all fed by the feeder 17. This provides an improved system 90 for predicting and signaling for control purposes the size of the set or job 14 of document sheets to be imaged and/or printed or copied, by a simple and low cost yet relatively accurate estimation or determination in relation to their stack height. It is usable with an exisiting type of recirculating type document handler (RDH) 20 with an exisiting type of set separator system 50 for an existing or novel copier, printer or other document imaging system. In such systems, when the documents are first loaded into the tray 16, the actual number of documents loaded is normally not known by the controller 100, unless that number was manually entered into an associated keypad or keyboard by the operator, from a manual count, which is clearly undesirable.

The disclosed dynamic document set size estimation control system 90 dynamically compares the document sheet output count 13 or 29 against the change in set separator stack height sensors 31, 32 status signals of "high", "medium" or "low". These status signals change as the set separator arm 52 is lowered as the sheets in the stack are being fed out by the feeder 17. The number or count of document sheets fed and counted at that point in time, when the stack height sensor status change occurs, is known (is stored) by the controller 100. This information enables more accurately measuring the stack 14 height and size (number of documents).

That is, in this improved system 90 it has been discovered that by reading the stack height sensors 31, 32 dynamically for their status change as the first portion of the stack is being initially fed out and counted at 13 and/or 29 that a much more accurate total set 14 count estimate can be made. The controller 100, which of course has internal timing and counting comparisons readily available, can be simply and readily programmed to look for and respond to a said brief change or transition in the signal coming from the connecting set separator system 50, and record the number of documents which have been fed at that point in time.

For example, assume an initial "high" stack height report from the set separator system 50. Assume that that could be, for example, anywhere from 50 to 180 documents loaded into the tray 14. However, now assume in this example that after feeding out and counting the first five documents the set separator system 50 sensors 31, 32 now signal a change in status to a "medium" stack height (e.g., 12 to 50 documents). Based on this information, the controller 100 can now estimate that there were a total of 50 plus 5 or approximately 55 total documents loaded, which is a much more accurate estimate than 50 to 180 documents. It can now also be estimated that approximately 50 or less documents remain to be imaged at that point in time.

To pick another example, this time assume the set separator "high" stack range is preset to represent an estimated range of 55–180 sheets, and the "medium" range as 22–55 sheets. If, in this case, there had been 20 document fed out to be scanned before the set separator switched to signal a "medium" rather than "high" stack height, then it can be assumed that there had been between 55 and 75 sheets in the stack 14. Note that this provides partial compensation or correction for different paper weights or thicknesses.

Furthermore, further partial compensation or correction for different paper weights or stack thicknesses can also be provided by continued dynamic estimation corrections. For example, at the subsequent sheet feeding point where the set separator system 50 sensors 31, 32 now signal a change in status from a "medium" stack height to a "low" stack height, the number of documents fed between the first or "high" to "medium" stack height transition and this "medium" to "low" transition may be counted and compared to the initial estimates of e.g., 22–55 or 25–55, to see if the actual count is on the low or high side of that range. Then the estimate of the remaining number of sheets in tray 14 at that point may be adjusted up or down, accordingly, from the initial "low" range upper end estimate (or even outside the range). Likewise the original estimate of the total number of documents in the set may be recalculated from this further information as to the actual number of documents fed between the "high" and "medium" transitions, and, if desired, the number fed between the "medium" to "low" transitions.

Preferably the "polling" or interrogation of the stack height sensor output by the controller is done repeatedly at a fixed time period rate, and only under conditions indicative of a change in stack height signal to a smaller stack height after a preset number of successive identical interrogation readings of that new stack height signal. This acts as a filter for avoiding erroneous stack height signal readings due to sensor noise or stack disturbance anomalies or vacillations in stack height signals at the transition boundaries.

If air knife fluffing of the document stack or other distubances in the sensor interrogation is not acceptable even with the above techniques or other averaging or hysterisis or the like then the air supply and can be briefly temporarily interrupted for a confirmation reading, although that is less desirable.

An initial calibration of the particular specific set separator may be desirable, to improve the accuracy of the estimations. This can be done by, for example, loading a stack of 100 standard weight (20#) copy paper original sheets into the RDH tray and feeding them out with a special diagnostic routine that counts and stores in non-volitile memory the actual sheet-fed count at the respective stack height level signal changes from that set separator.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a sheet feeding and imaging system, with a sheet stacking and feeding tray in which a set of document sheets may be stacked to be sequentially fed from said tray by a sheet feeder for image processing, and sheet counting means for providing a count of the number of document sheets fed from said tray, and a set stack height estimating means for providing plural distinct discrete stack height control signals responsive to the height of said set of sheets in said tray, and control means electrically connecting with said set stack height estimating means for providing preset estimates corresponding to respective said discrete estimated stack height control signals of the number of said document sheets in said set; the improvement wherein said operation of said set stack height estimating means and said sheet counting means is dynamically monitored and compared by said control means for determining a specific said count of the number of said document sheets which have been fed from said tray prior to a change occurring in said distinct discrete estimated stack height control signals during at least the initial feeding of said document sheets, and said preset estimate from the respective said discrete estimated stack height control signal of the number of said document sheets in said set is modified in accordance with said specific count, and wherein said sheet feeding system is a recirculating document handler and said set of document sheets are a set of documents being plurally recirculated in a document circulation path for imaging and returned in said document circulation path back to said same tray to be restacked in said tray, and said set stack height estimating means is an electromechanical system in which a finger is set on top of said set of document sheets as they are initially loaded into said tray, and said document sheets are fed out from under said finger by said sheet feeder, and the position of said finger provides said discrete stack height control signals.

2. The sheet feeding and imaging system of claim 1, wherein said discrete estimated stack height control signals are a "high", "medium" and "low" signal.

3. The sheet feeding and imaging system of claim 1, wherein said modification of said estimated number of said document sheets in said set comprises said control means adding said count of said number of said document sheets which have been fed from said tray prior to a change occuring in said discrete stack height control signal to said prior preset estimated number of said document sheets in said set corresponding to the most recent said discrete stack height control signal thereto.

4. The sheet feeding and imaging system of claim 1, wherein said control means interrogates said stack height control signals of said set stack height estimating means repeatedly at a periodic rate, only under conditions indicative of a change in said discrete stack height control signals to a new stack height control signal indicative of a smaller stack, and only responds thereto after a preset number of successive identical said periodic interrogation sensings of said new and smaller stack height control signal, to provide filtering for avoiding erroneous stack height control signal readings.

5. The system of sheet feeding and imaging of claim 1 wherein said sheet feeder for image processing is a sequential electronic document imager with an electronically associated printer for printing the images of said document sheets, and wherein said modified preset estimate of the number of said document sheets in said set controls the starting time of said printer to start said printer at a desired starting time in relation to said sheet feeder image processing.

* * * * *